US006367090B1

(12) United States Patent
Im

(10) Patent No.: US 6,367,090 B1
(45) Date of Patent: Apr. 9, 2002

(54) REVERSIBLE TWO COLOR PROTECTIVE HEADGEAR AND BLANK THEREFOR

(76) Inventor: Sang Jun Im, 3903 Tedrich Blvd., Fairfax, VA (US) 22031

( * ) Notice: Subject to any disclaimer, the term of this patent is extended or adjusted under 35 U.S.C. 154(b) by 0 days.

(21) Appl. No.: 09/799,712

(22) Filed: Mar. 7, 2001

(51) Int. Cl.[7] ..... A63B 71/10
(52) U.S. Cl. ..... 2/425; 2/411
(58) Field of Search ..... 2/425, 411, 412, 2/417, 418, 419, 423, 410; D29/106

(56) References Cited

U.S. PATENT DOCUMENTS 532,567 A * 1/1895 Larwood, Jr.
2,969,547 A * 1/1961 Dye
3,075,200 A * 1/1963 Crouzet
3,551,911 A * 1/1971 Holden
3,594,815 A * 7/1971 Reese
3,668,704 A * 6/1972 Conroy et al.
3,992,722 A * 11/1976 Rhee
4,279,038 A * 7/1981 Bruckner
D268,696 S * 4/1983 Bowen
5,361,420 A * 11/1994 Dobbs et al.
5,790,988 A * 8/1998 Guadagnino, Jr. et al.
6,088,840 A * 7/2000 Im
6,282,721 B1 * 9/2001 Travalgia

FOREIGN PATENT DOCUMENTS

DE 3632525 * 3/1988
WO 99/29199 * 6/1999

* cited by examiner

*Primary Examiner*—Rodney M. Lindsey

(57) ABSTRACT

An improved headgear for martial arts contestants which is reversible so as to be wearable on both sides, and a blank from which the headgear is erected. The headgear comprises a blank of protective foam erected to form a head covering wherein the blank has a first color on one side and a second color on the other side whereby a competitor is provided with a comfortable and proper head protection regardless of the attitude of the headgear and may select one of the two colors simply by turning the headgear inside out. The construction of the headgear facilitates reversibility by means of the design of the blank and an elastic strap member at the rear of the headgear.

16 Claims, 4 Drawing Sheets

REVERSIBLE TWO COLOR PROTECTIVE HEADGEAR AND BLANK THEREFOR

FIELD OF THE INVENTION

The present invention is directed to an improved headgear for martial arts contestants which is reversible so as to be wearable on both sides. The headgear comprises a blank of protective foam erected to form a head covering wherein the blank has a first color on one side and a second color on the other side whereby a competitor is provided with a comfortable and proper head protection regardless of the attitude of the headgear and may select one of the two colors simply by turning the headgear inside out. The construction of the headgear facilitates reversibility by means of the design of the blank and an elastic strap member at the rear of the headgear.

BACKGROUND OF THE INVENTION

Since Taekwondo has become an advanced category in the Olympic Games, the number of Taekwondo practitioners has increased dramatically. To prevent injury, competitors are required to wear protective headgear. The headgear is provided in a single color. However, in order to make it easier to distinguish the competitors during a bout, competition directors have begun requiring competitors to wear different colored headgear. This requires that competitors carry at least two pieces of headgear to competitions, sometimes more, or to borrow headgear from other competitors. Often competitors do not know what color of headgear to wear until immediately prior to the competition. Accordingly, what is needed is a bicolor headgear that is reversible for use in either an obverse or reverse configuration, the obverse side being of one color and the reverse being of another color, and which is simple and economical to manufacture while meeting the protection requirements of the World Taekwondo Federation.

BACKGROUND OF PRIOR ART:

Reversible head wear which has different colors or patterns on each side are known as shown by U.S. Pat. No. 1,111,659, LePierre, U.S. Pat. No. 1,538,847, Wheeler, U.S. Pat. No. 3,187,345, Holford and U.S. Pat. No. 5,181,277, Sherman. However, these hats do not provide the shock absorbent protection needed by competitors in martial arts and other sports.

Protective headgear for martial arts and other sports is commonly made from foam material covered by a pliable surface coating so as to be lightweight yet shock absorbent. The headgear are shaped to encompass the wearer's head and provide protection to all surfaces while permitting the wearer to see, breath and hear. Due to their vulnerability, extra protection is often provided over the ears. Examples of such prior art headgear are U.S. Pat. No. 4,222,122, Toms, U.S. Pat. No. 4,279,038, Bruckner, et al., and U.S. Pat. No. 4,706,305, Cho. Each of these types of headgear provide protection to the wearer's head but are useable in only one configuration.

The nature of the design and construction of the prior art headgear is such that they are formed so as to conform to the shape of the human head when in their correct, or right side out, configuration. When reversed, the headgear no longer conform to the cranial contours. Thus, they do not fit properly and are not useable in their intended manner. Although the materials from which they are made are resilient and flexible such that the prior art headgear are physically capable of being turned inside out, since no allowance is made to accommodate the stretching that occurs during reversal, those stresses tend to cause the materials to rupture and tear further rendering the prior art headgear unsuitable for reversible use.

The present inventor has sought to provide an adequate bicolor reversible headgear in his prior U.S. Pat. No. 6,088,840 and, to the extent that the headgear disclosed therein is of two colors and is reversible, he has succeeded. However, the structure of that prior headgear presents manufacturing difficulties with respect to its assembly. Specifically, the present inventor's prior headgear comprises a plurality of separate panels that are connected to form the shape of the headgear by individual strips of elastic material preferably let into slits cut in the edges of each panel. Difficulty arises in the creation of uniform slits, insertion and securing of the elastic material and maintaining the proper arrangement of the panels while the elastic is secured in place.

By the present invention, the inventor herein has overcome the deficiencies of the prior art, including his own patent, by providing a one piece blank which can be molded from foam precursors or cut from a sheet of foam and which has a shape which facilitates both the erection of the blank into a protective headgear as well as the reversal of the headgear once erected so as to permit easy change from one color to the other without undue stress on the fabric of the headgear itself. Furthermore, the headgear erected from the blank, in addition to being reversible, is comfortable and provides the desired degree of protection to the user.

SUMMARY OF THE INVENTION

The present invention provides a one piece blank of resilient foam material cut so as to provide a series of planarly connected panels which, when assembled, provides a reversible protective headgear, wherein the blank comprises:

a first region comprising left and right side panels connected by an intervening forehead panel, a second region comprising a crown panel connected to said forehead panel by a bridge panel along an upper edge thereof and substantially midway between said left and right side panels, said crown panel comprising left and right lobes each having an edge bondable to a cooperating portion of an upper edge of said left and right side panels, said second region tapering in a direction opposite from said bridge panel to form a tail piece extending from said crown panel substantially midway between said left and right lobes.

The invention further provides a reversible, two color protective headgear erected from a one piece blank of resilient foam wherein said blank comprises: a first region comprising left and right side panels connected by an intervening forehead panel, a second region comprising a crown panel connected to said forehead panel by a bridge panel along an upper edge thereof and substantially midway between said left and right side panels, said crown panel comprising left and right lobes each having an edge bondable to a cooperating portion of an upper edge of said left and right side panels, said second region tapering in a direction opposite from said bridge panel to form a tail piece extending from said crown panel substantially midway between said left and right lobes, said panels and tailpiece being in planar arrangement;

wherein said bondable edge of each of said left and right lobes of said crown panel describe an arc which corresponds to said cooperating portion of said upper edge of said left and right side panels whereby bonding of said left lobe edge to said left side panel edge and said right lobe edge to said right side panel edge erects said blank into said headgear.

The invention still further provides a blank of resilient foam material and two color reversible headgear erected therefrom comprising a left side panel, a right side panel, a forehead panel and a crown panel, wherein the left and right side panels are joined by a forehead panel and each substantially cover the side of the head from the temples rearward to the back of the head and from just below the crown of the head downward over the ears and cheeks and having openings over the ears. The crown panel is attached to the forehead panel by a bridge panel so as to be spaced therefrom and comprises left and right lobes which are bonded to the upper edges of the left and right side panels when the blank is erected to form the headgear. Rearward of the lobes, the crown panel tapers to form a tail piece which extends downward over the back of the head between and separate from the rear edges of the left and right side panels. An elastic strap member connects the rear edges of the left and right side panels behind the wearer's head and also serves to releasably hold the free end of the tail piece. The blank comprises a resilient foam material having a first color on one side and a second color on the other side whereby the headgear is reversible by turning inside out to expose the first color in a first configuration and the second color in a second configuration.

It is therefor an object of the present invention to provide a one piece blank of resilient foam material which is capable of being erected to form a protective and reversible headgear for martial arts and other sports.

It is a further object to provide a reversible protective headgear erectable from the blank which has a first color on one side and a second color on the other side.

It is a still further object to provide a reversible protective headgear from the blank having means to facilitate reversal and which conforms to the head in both the obverse and reverse configuration.

Further objects and advantages will become evident from the accompanying drawings and descriptions.

DETAILED DESCRIPTION OF THE INVENTION

Figure 1:
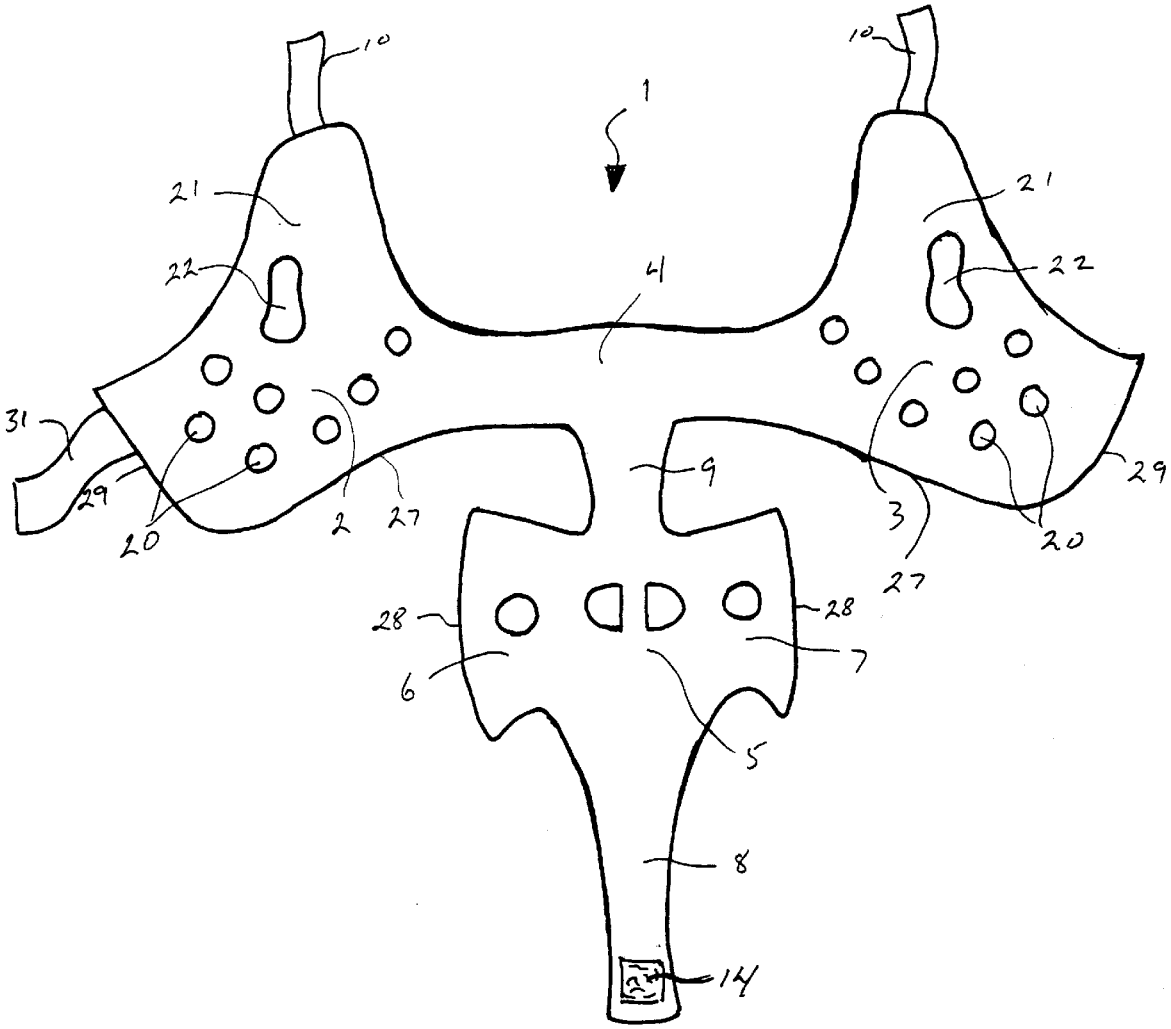
FIG. 1 is a planar view of the blank of the present invention.

FIG. 1 illustrates a preferred design for the blank 1 of the present invention which preferably comprises a single piece of resilient foam material comprising a plurality of unitarily connected panels and, preferably, an outer protective coating of a smooth, flexible material having a different color on each side of the blank 1. The shape of the blank 1 is such that, when erected to form a headgear, there is sufficient flexibility to permit reversal of the headgear by turning it inside out without undue stress being applied to the foam material and the protective covering which would cause them to tear.

The blank 1 is fabricated of a suitable material, conformable and resilient, as well as capable of absorbing energy when contacted and deformed by a blow. Preferred materials include elastomers such as closed cell polyurethane foam or the like. The foam material is preferably provided with a surface coating or casing which entirely covers the surface of the foam and which may be colored or have color applied to it before drying. The coating may be applied by painting, dipping, spraying or other means. A tough, rugged, pliable plastic such as polyvinyl chloride has been found to provide a suitable coating. Alternatively, the coating may be a soft woven or nonwoven fabric which is applied and bonded to the foam, in which case, the fabric may be colored before or after application so as to provide the desired contrasting colors on each side of the headgear. In a further alternative, the foam may be colored on each planar surface and a clear protective sealant applied overall. In a still further alternative, the outer covering or coating may comprise two separate sheets of plastic or fabric, each of a different color, which are placed over each planar surface of the foam blank 1 and sewn or otherwise adhered together about their periphery and through any apertures in the foam so as to conform to the shape thereof. Any means by which the two planar sides of the blank 1 can have contrasting colors applied to them may be used and remain within the scope of this invention.

The blank 1 is preferably cut to shape from a sheet of foam by any suitable means or it may be molded to shape by reaction of foam precursors in a mold having the desired shape and dimensions of the blank 1. Ventilation holes 20 are cut or molded in where desired and the coating is applied. Each side of the blank 1 is coated with a different color and the blank 1 is erected into the final headgear so that a first color is continuous on one side and a second color is continuous on the other side of the headgear.

In a further embodiment, the blank 1 may be made up from two identical half-thicknesses of foam which are separately prepared and colored so that each half-thickness is a different color. The half-thicknesses are then bonded together to form the complete two color blank. In this embodiment, accurate registration of the two half-thicknesses may be achieved by means of registration pins applied through several of the ventilation holes 20 thereby ensuring that the two half-thicknesses are properly aligned before bonding. As a bonding agent, any adhesive suitable to the particular foam material or outer coating which remains flexible after setting may be used. Additionally, any other suitable means for bonding the two half-thicknesses may be used.

The blank 1 of the headgear comprises a left side panel 2, a right side panel 3, a forehead panel 4 transitioning between the left and right side panels 2 and 3, a crown panel 5, and a bridge panel 9 connecting the crown panel 5 to the forehead panel 4 substantially at the midpoint thereof. The crown panel comprises left and right lobes 6 and 7 and tail piece 8. Left and right side panels 2 and 3 are shaped so as to cover the side of the head from just below the crown, downward over the temples, ears and cheeks. Rearwardly, left and right side panels 2 and 3 extend over the rear curvature of the head to the neck but do not meet. Openings 22 are provided in the cheek panels 21 of the left and right side panels 2 and 3 over the ears to allow air flow and permit equalization of air pressure within the ears. If needed, additional ear protection may be provided in the form of extra thickness or foam around openings 22 on one or both sides of the blank 1, or by inserts placed within the openings 22 in a manner that maintains the necessary air flow while providing protection to the outer ear.

Although the individual panels of the blank 1 may be cut from a sheet of foam and then bonded together at their edges to form the blank 1, preferably the blank 1 is cut or molded as a single piece as shown in FIG. 1. A single piece provides a more uniform degree of resilience and protection from the final headgear whether in the obverse or reverse configuration.

Figure 2:
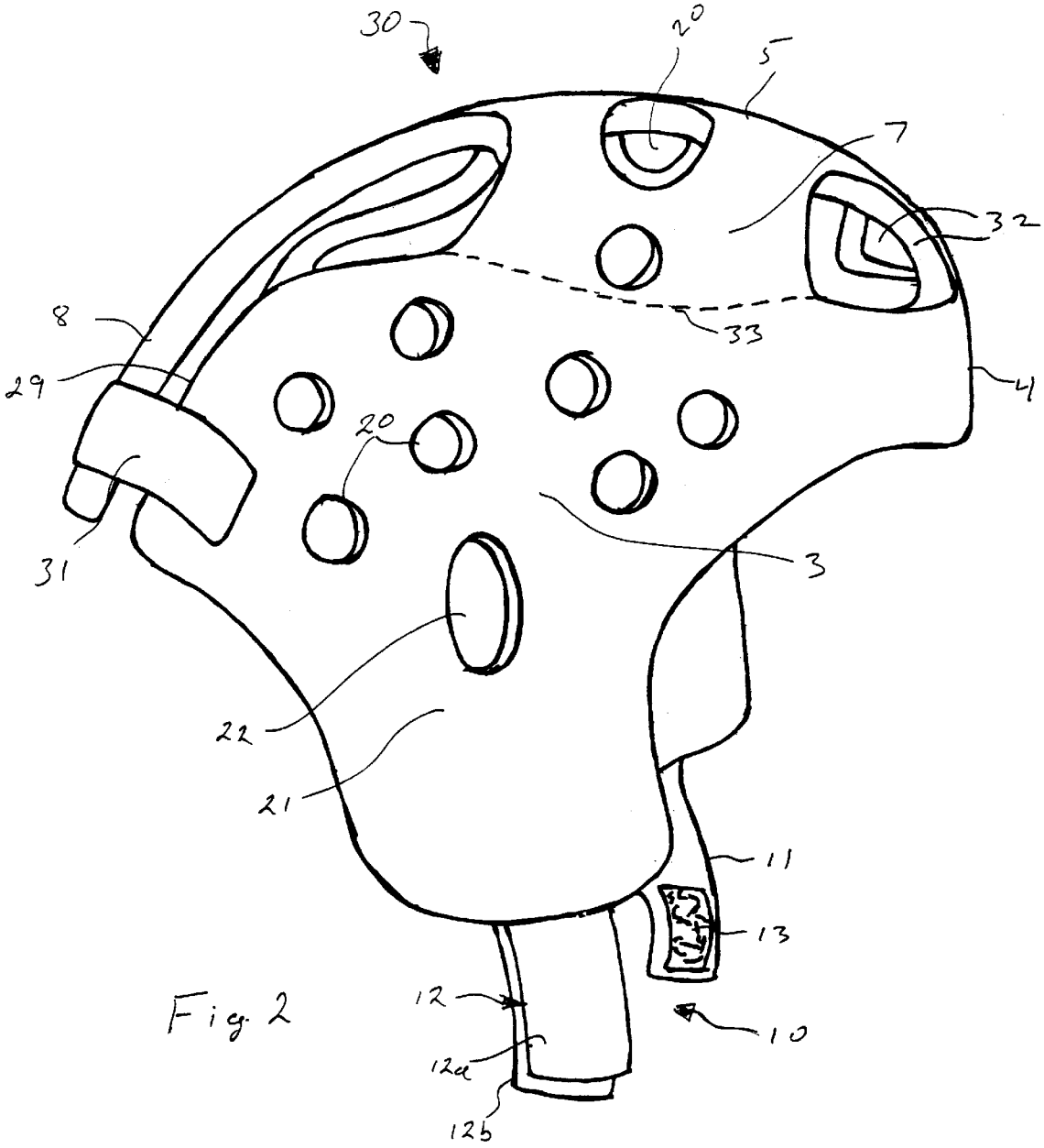
FIG. 2 is a side view of the reversible headgear of the present invention.
Figure 3:
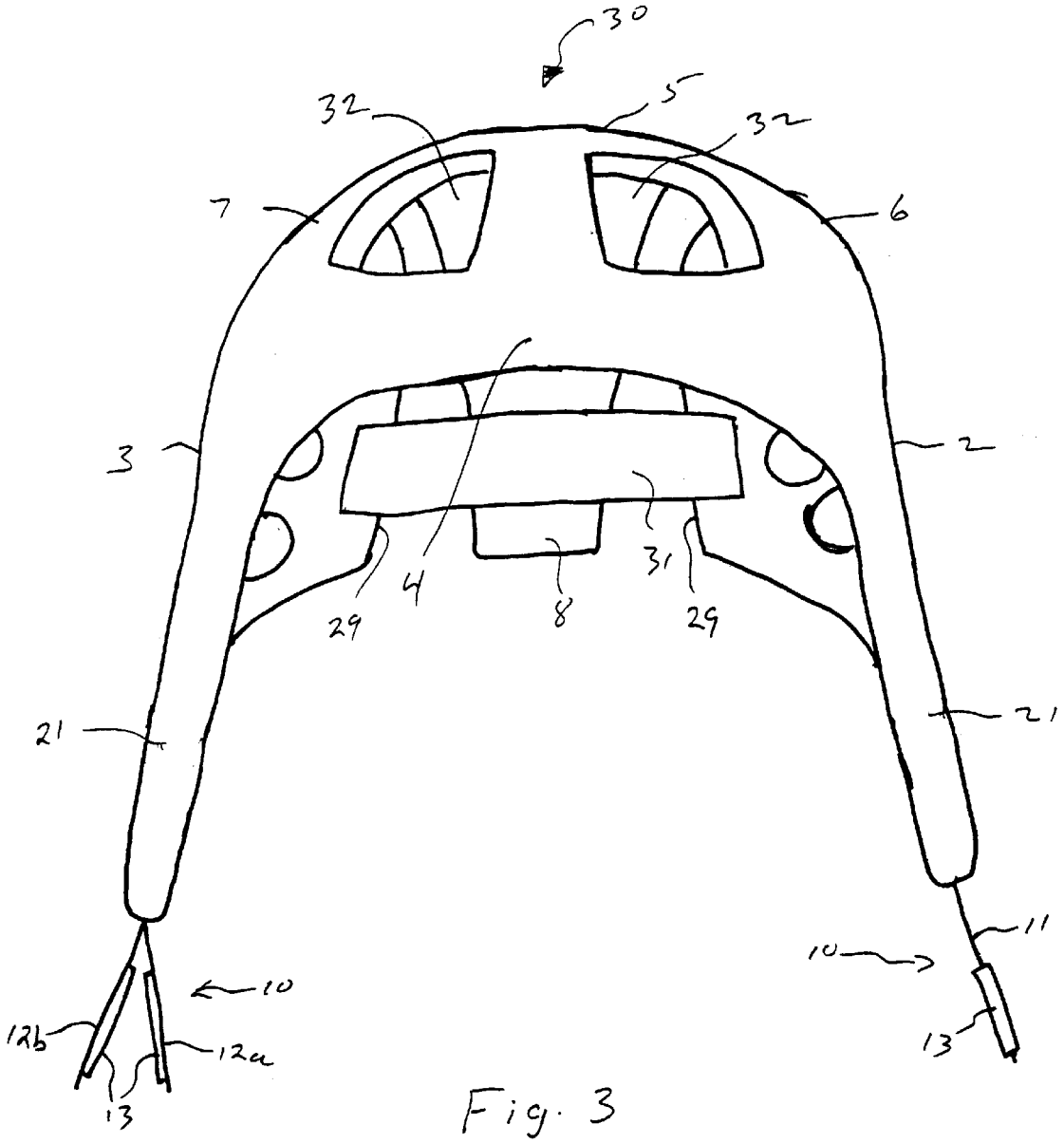
FIG. 3 is a front view of the reversible headgear of the present invention.
Figure 4:
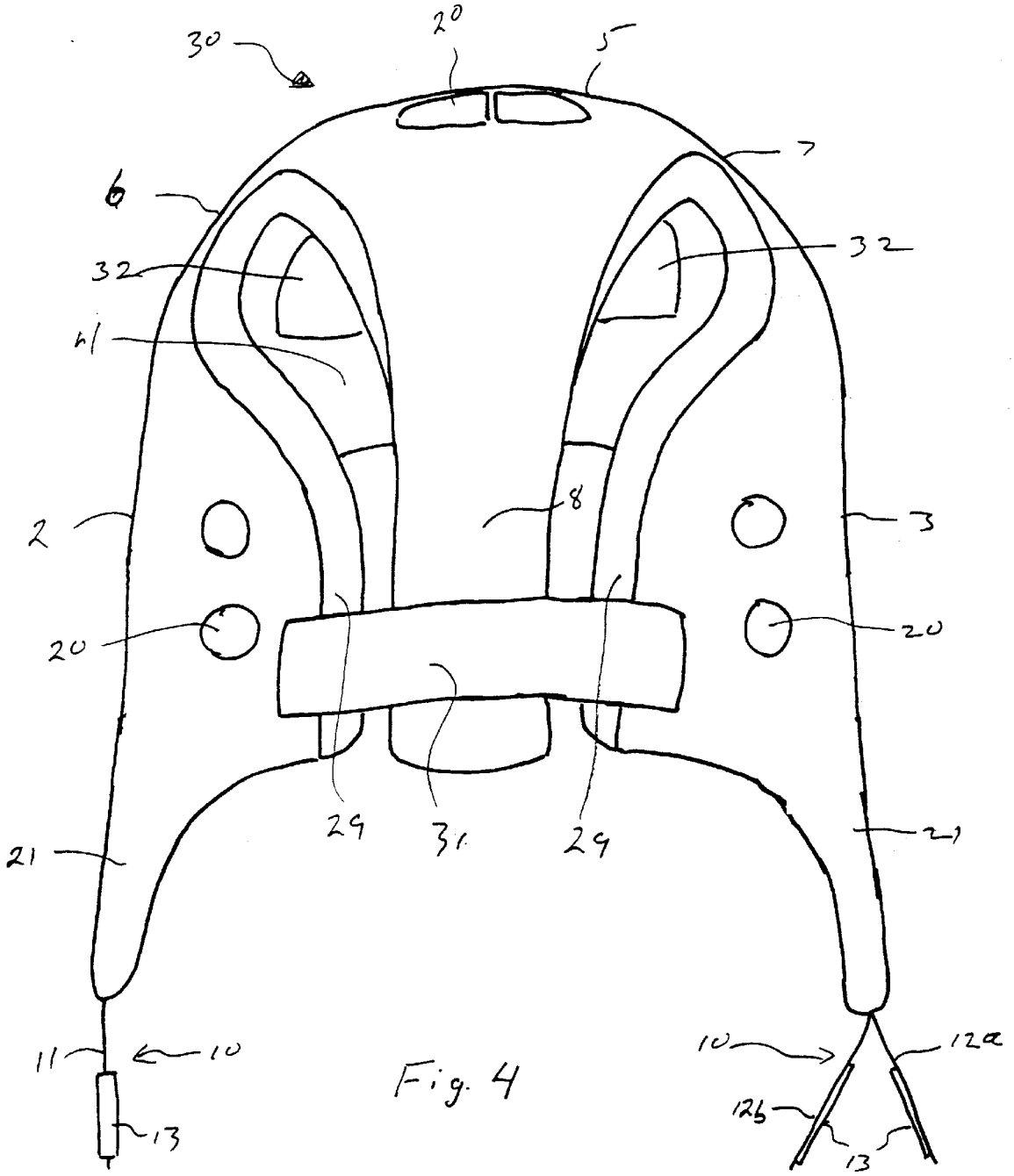
FIG. 4 is a rear view of the reversible headgear of the present invention.

Crown panel 5 is spaced from the forehead panel 4 by bridge panel 9 so as to be located over the crown or top of the head from the upper edge of the forehead rearward to a point just above the back of the head with tail piece 8 extending downward over the back of the head. Left and right lobes 6 and 7 of crown panel 5 span the space between the upper edge 27 of left and right side panels 2 and 3. Edges 28 of lobes 6 and 7 are curved to correspond to the curvature of the upper edge 27 of left and right side panels 2 and 3. This curvature corresponds substantially to the general curvature of the human head so that when edges 27 and 28 are bonded together the blank, 1 takes on the shape of the headgear as shown in FIGS. 2–4. The bonded edges 27 and 28 are shown for reference in FIG. 2 by broken line 33. Bonding of edges 27 and 28 may be by any suitable means including adhesive, heat, sewing, etc.

Rearward of lobes 6 and 7, crown panel 5 tapers to form tail piece 8 which is of a length to extend downward over the back of the user's head between the rear edges 29 of left and right side panels 2 and 3 as shown most clearly in FIG. 4. The shape of tail piece 8 and the fact that it is separate and not connected to the rear edges 29 of side panels 2 and provides the means whereby the headgear 30 can be easily reversed without overstressing the foam material or the coating. As noted previously herein, the curvature of edges 27 and 28 is such that the blank 1 conforms substantially to the contours of the human head when the blank 1 is erected to form the headgear 30 by joining the edges 27 and 28 on each side of the blank 1. To further draw the headgear 30 into the proper shape and provide a means to releasably hold the end of the tail piece 8 down against the back of the head, an elastic strap member 31 is secured between the left and right side panels 2 and 3 across the back of the head. Making the strap member 31 out of an elastic material allows the side panels 2 and 3 to separate when the headgear is turned inside out thereby reducing the stress applied to the foam and the coating. In the simplest embodiment, a single strap 31 is used and the tail piece 8 is simply tucked in between it and the user's head. However, in a preferred form of the headgear 30, two identical straps 31 are used and arranged so that the tail piece 8 fits between them. To secure the tail piece 8 in place and prevent it from working free, a releasable fastener 14, such as a hook and loop fastener is provided with one half of the fastener 14 being on the inside surface of each strap 31 and the other half of the fastener 14 being on secured on each side of the tail piece 8 just above the free end thereof. The fastener 14 engages when the end of the tail piece 8 is placed between the two straps 31.

Thus, to allow the headgear to stretch when being reversed and thereby relieve the stress that would normally be applied to the foam and coating during that procedure, the lobes 6 and 7 are joined to side panels 2 and 3 only along their cooperating edges 27 and 28 and tail piece 8 is free along its length. Strap member 31 allows side panels 2 and 3 to spread and flex when the headgear is turned inside out. The only other connection of the crown panel 5 to the side pieces 2 and 3 is through the relatively narrow bridge panel 9 between the crown panel 5 and the forehead panel 4. Bridge panel 9 spaces the crown panel 5 from the side panels 2 and 3 so that when the lobes 6 and 7 are joined to the side panels 2 and 3, apertures 32 are formed above the forehead panel 4 on either side of the bridge panel 9. These apertures 32, in addition to providing ventilation, contribute to the flexibility of the headgear 30 in that they permit the crown panel 5 to flex inward when the headgear 30 is turned inside out.

Extending from the cheek panels 21 of the headgear 30 is a chin strap 10 which is designed to facilitate use in either the obverse or reverse configuration. As shown in FIGS. 2–4, the chin strap 10 comprises a first strap portion 11 secured to one cheek panel 21 in the same manner as the elastic strap 31, and a second strap portion 12 similarly secured to the other cheek panel 21. First strap portion 11 is a single strap with one half of a hook and loop fastener 13 secured to both sides thereof. Second strap portion 12 consists of two straps 12*a* and 12*b* secured to the other cheek panel so as to be coextensive and to receive the first strap portion 11 therebetween. The facing surfaces of the two straps of the second strap portion 12 have the other half of the hook and loop fastener 13 secured thereto. To secure the chin strap 10 in either configuration of the headgear, the first strap portion 11 is placed between the two straps of the second strap portion 12 and the hook and loop fastener is engaged. Although this form of chin strap is preferred, other forms which support the reversibility of the headgear 30 may be used. For example, a simple pass through and securing means where one strap passes through a slot or ring on the end of the other strap and is then folded back on itself with a securing means like a hook and loop fastener may be used.

The foregoing construction provides a full coverage protective headgear, and a blank for erecting the same, having a first color on one side and a second color on the other side and which is fully reversible to expose either color to view by turning the headgear inside out. The reversibility of the headgear is facilitated by the configuration and construction of the blank, in particular the shape and method of operation of the crown panel and tail piece which provide the headgear with the means to conform to the head regardless of the configuration.

The above description and drawings illustrate the preferred embodiment of the present invention and it is understood that many variations and modifications will be evident to those skilled in the art and may be carried out without departing from the spirit and scope of the present invention.

What is claimed is:

1. A one piece blank of resilient foam material cut so as to provide a series of planarly connected panels which, when assembled, provides a reversible protective headgear, wherein the blank comprises:

a first region comprising left and right side panels connected by an intervening forehead panel, a second region comprising a crown panel connected to said forehead panel by a bridge panel along an upper edge thereof and substantially midway between said left and right side panels, said crown panel comprising left and right lobes each having an edge bondable to a cooperating portion of an upper edge of said left and right side panels, said second region tapering in a direction opposite from said bridge panel to form a tail piece extending from said crown panel substantially midway between said left and right lobes.

2. The one piece blank of claim 1 wherein said left and right side panels each comprise an elongated cheek panel extending therefrom in a direction opposite to said bridge panel.

3. The one piece blank of claim 2 wherein said cheek panels are provided with apertures which form ear openings when said blank is erected into said headgear.

4. The blank of claim 3 further comprising releasably fastenable strap means secured to said cheek panels and forming a chin strap when said blank is erected into said headgear.

5. The blank of claim 4 further comprising an elongated strap member having one end attached to one of said left and right side panels and the other end adapted to be secured to the other of said left and right side panels when said blank is erected into said headgear, whereby said strap member passes behind the user's head and comprises means to receive and hold said tail piece.

6. The blank of claim 5 wherein said chin strap and said elongated strap member are elastic.

7. The blank of claim 5 having a first color applied to a first side and a second color applied to a second side.

8. The blank of claim 5 comprising a first half-thickness of said foam of a first color and a second half-thickness of said foam of a second color, said first and second half-thicknesses being placed in registry and bonded together across adjoining sides to form said blank.

9. The blank of claim 8 wherein said chin strap and said elongated strap member are secured between said half-thicknesses of foam.

10. The blank of claim 3 wherein the outer edge of each of said left and right lobes of said crown panel describe an arc which corresponds to said cooperating portion of said upper edge of said left and right side panels above said cheek panels whereby bonding of said left lobe edge to said left side panel edge and said right lobe edge to said right side panel edge erects said blank into said headgear.

11. A reversible, two color protective headgear erected from a one piece blank of resilient foam wherein said blank comprises:

a first region comprising left and right side panels connected by an intervening forehead panel, a second region comprising a crown panel connected to said forehead panel by a bridge panel along an upper edge thereof and substantially midway between said left and right side panels, said crown panel comprising left and right lobes each having an edge bondable to a cooperating portion of an upper edge of said left and right side panels, said second region tapering in a direction opposite from said bridge panel to form a tail piece extending from said crown panel substantially midway between said left and right lobes, said panels and tailpiece being in planar arrangement;

wherein said bondable edge of each of said left and right lobes of said crown panel describe an arc which corresponds to said cooperating portion of said upper edge of said left and right side panels whereby bonding of said left lobe edge to said left side panel edge and said right lobe edge to said right side panel edge erects said blank into said headgear.

12. The headgear of claim 11 wherein said blank has a first color applied to a first side and a second color applied to a second side.

13. The headgear of claim 12 further comprising an elongated strap member attached to and connecting said left and right side panels across the back of a user's head and wherein said tail piece is of sufficient length to extend downward over the back of a user's head to be releasably receivable by said strap member whereby said tail piece is held against the back of said user's head.

14. The headgear of claim 13 wherein said strap member and said tail piece have releasable cooperative fastening means operable in either of the reversible configurations of said headgear.

15. The headgear of claim 14 wherein said left and right side panels of said blank comprise elongated cheek panels extending downward therefrom to pass over a user's cheeks and ears, said cheek panels having releasable chin strap means attached thereto.

16. The headgear of claim 15 further comprising apertures in said cheek panels corresponding to the location of a user's ears and providing means to equalize air pressure.

* * * * *